US009010119B2

(12) United States Patent
Myers

(10) Patent No.: US 9,010,119 B2
(45) Date of Patent: Apr. 21, 2015

(54) PREMIXING NOZZLE

(75) Inventor: Geoffrey David Myers, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1059 days.

(21) Appl. No.: 12/938,899

(22) Filed: Nov. 3, 2010

(65) Prior Publication Data

US 2012/0102957 A1 May 3, 2012

(51) Int. Cl.

| | |
|---|---|
| ***F02C 1/00*** | (2006.01) |
| ***F23R 3/36*** | (2006.01) |
| ***F23R 3/32*** | (2006.01) |
| ***F23R 3/28*** | (2006.01) |

(52) U.S. Cl.
CPC . *F23R 3/286* (2013.01); *F23R 3/36* (2013.01); *F23R 3/32* (2013.01)

(58) Field of Classification Search
USPC ..... 60/737, 740, 742, 746, 747, 39.463, 60/748, 804
See application file for complete search history.

(56) References Cited

U.S. PATENT DOCUMENTS

| | | | | |
|---|---|---|---|---|
| 5,085,575 | A | 2/1992 | Keller et al. | |
| 5,295,352 | A | 3/1994 | Beebe et al. | |
| 5,351,477 | A | 10/1994 | Joshi et al. | |
| 5,408,825 | A | 4/1995 | Foss et al. | |
| 5,511,375 | A | 4/1996 | Joshi et al. | |
| 6,334,309 | B1 * | 1/2002 | Dean et al. | 60/737 |
| 7,140,560 | B2 | 11/2006 | Stotts et al. | |
| 7,900,456 | B2 * | 3/2011 | Mao | 60/740 |
| 8,015,815 | B2 * | 9/2011 | Pelletier et al. | 60/740 |
| 8,166,763 | B2 * | 5/2012 | Piper et al. | 60/737 |
| 2006/0165898 | A1 * | 7/2006 | Kodas et al. | 427/258 |
| 2006/0236700 | A1 | 10/2006 | Saitoh et al. | |

* cited by examiner

*Primary Examiner* — William H Rodriguez
*Assistant Examiner* — Arun Goyal
(74) *Attorney, Agent, or Firm* — Cantor Colburn LLP

(57) ABSTRACT

A premixing nozzle of a combustor is provided and includes a gas premixer module, a centerbody, which is breech-loadable into the gas premixer module and a deformable, compliant interface between the gas premixer module and the centerbody.

19 Claims, 4 Drawing Sheets

PREMIXING NOZZLE

BACKGROUND OF THE INVENTION

The subject matter disclosed herein relates to a premixing nozzle of a combustor used in a low emissions industrial gas turbine.

In combustion systems of low emissions gas turbine engines, sometimes referred to as Dry, Low NOx (DLN) combustors, premixed air and fuel are combusted within combustors that are disposed upstream from turbines in which mechanical energy is derived from the high temperature fluids produced by the combustion. Electrical energy is then generated from the mechanical energy and transmitted to electrical circuits. The combustors typically include fuel nozzles having premixing passages in which the air and fuel are mixed with one another. This premixing is done to decrease the peak flame temperatures in the combustor and reduce the formation of oxides of nitrogen (NOx) in the exhaust stream.

For fuel flexibility and power system availability, low emissions gas turbines are often equipped with a system to inject oil as a secondary or backup fuel in addition to the gas premixers. These oil injectors are typically inserted through the center of the gas premixers, such that the oil injection outlet communicates with the combustor reaction zone. Since the oil fuel is not evaporated and premixed with the air prior to combustion but is injected directly into the reaction zone, large quantities of water (several hundred thousand gallons per day in the case of a large power generation turbine) must be injected into the reaction zone to reduce the flame temperatures and the NOx emissions to the levels specified by regulators. Indeed, current methods often require that more water than fuel be directly injected to reach NOx levels near 42 ppm that are commonly expected when firing on oil fuel.

Also, in current breech-loaded/oil cartridge/gas premixer assemblies, concentric tubes, which are all rigidly supported on one end and free to move relative to one another on the far end are nested within one another. During turbine operations, the far ends of the tubes tend to vibrate in response to wide spectrum noise generated by the gas turbine engine and contact one another. The tubes and nozzle tip components are, therefore, prone to severe wear and fretting between mating parts.

BRIEF DESCRIPTION OF THE INVENTION

According to one aspect of the invention, a premixing nozzle of a combustor is provided and includes a gas premixer module, a centerbody, which is breech-loadable into the gas premixer module and a deformable, compliant interface between the gas premixer module and the centerbody.

According to another aspect of the invention, a premixing nozzle of a combustor having an endcover is provided and includes a gas premixer module mounted onto the endcover, a centerbody, which is breech-loadable through the endcover and into the gas premixer module and a deformable, compliant interface between the gas premixer module and the centerbody.

According to yet another aspect of the invention, a premixing nozzle of a combustor is provided and includes an outerbody having an outer annular shroud formed to define a premixing chamber and an inner annular wall formed to define a premixing passage between an outer surface thereof and the outer annular shroud upstream from the premixing chamber, a centerbody, which is loaded into a breech defined by the inner annular wall, to deliver fuel to the premixing passage and a sealing element disposed for radial interposition between an inner diameter of the inner annular wall and an outer diameter of the centerbody to support the centerbody within the breech.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Internal components of a premixing nozzle of a combustor are cantileverably supported by use of welding, brazing, threaded connections, conical fits or simply increased contact surface dimensions and additionally supported by sealing elements along their lengths. Differential thermal growth between a centerbody and a gas premixer module is permitted while vibrations are damped and deadened. The sealing elements do not provide a strong thermal conduction path between the modules and thus help to isolate the liquid-fuel wetted surfaces in the centerbody.

Figure 1:
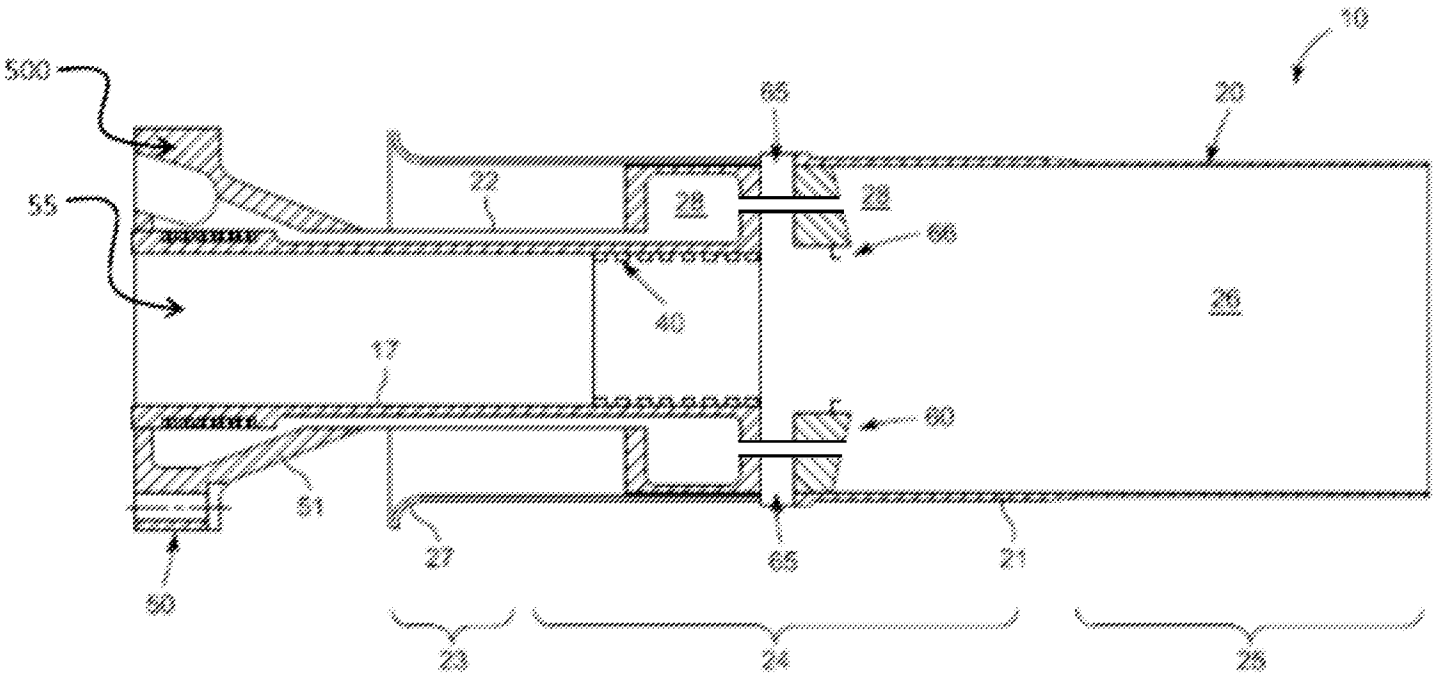
FIG. 1 is a side sectional view of a gas premixer module.
Figure 2:
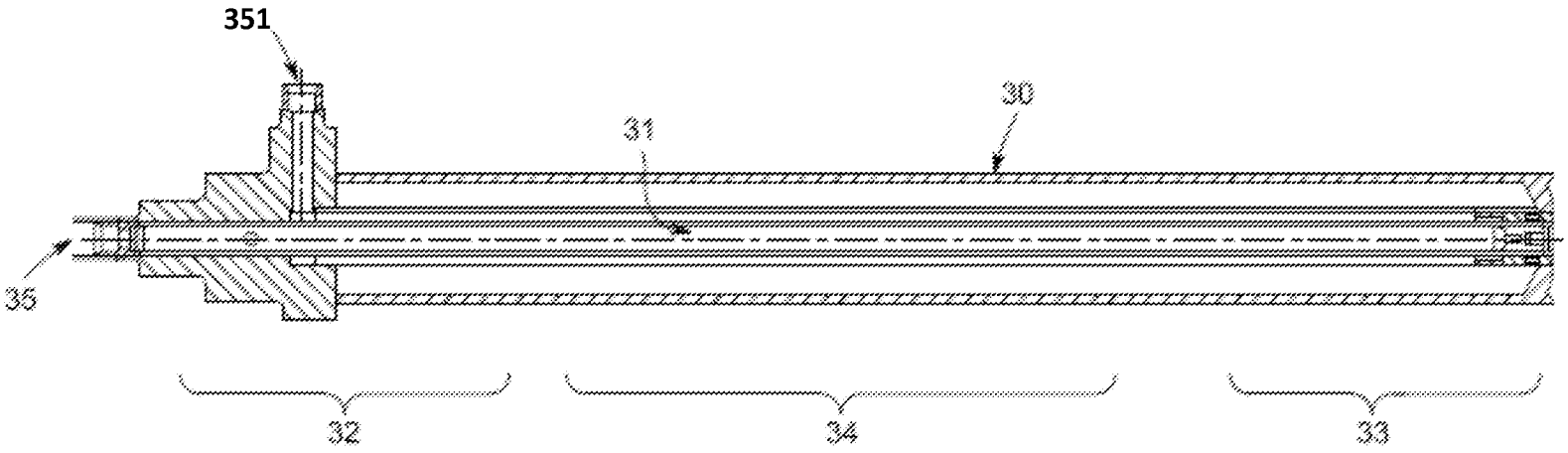
FIG. 2 is a side sectional view of a centerbody.
Figure 3:
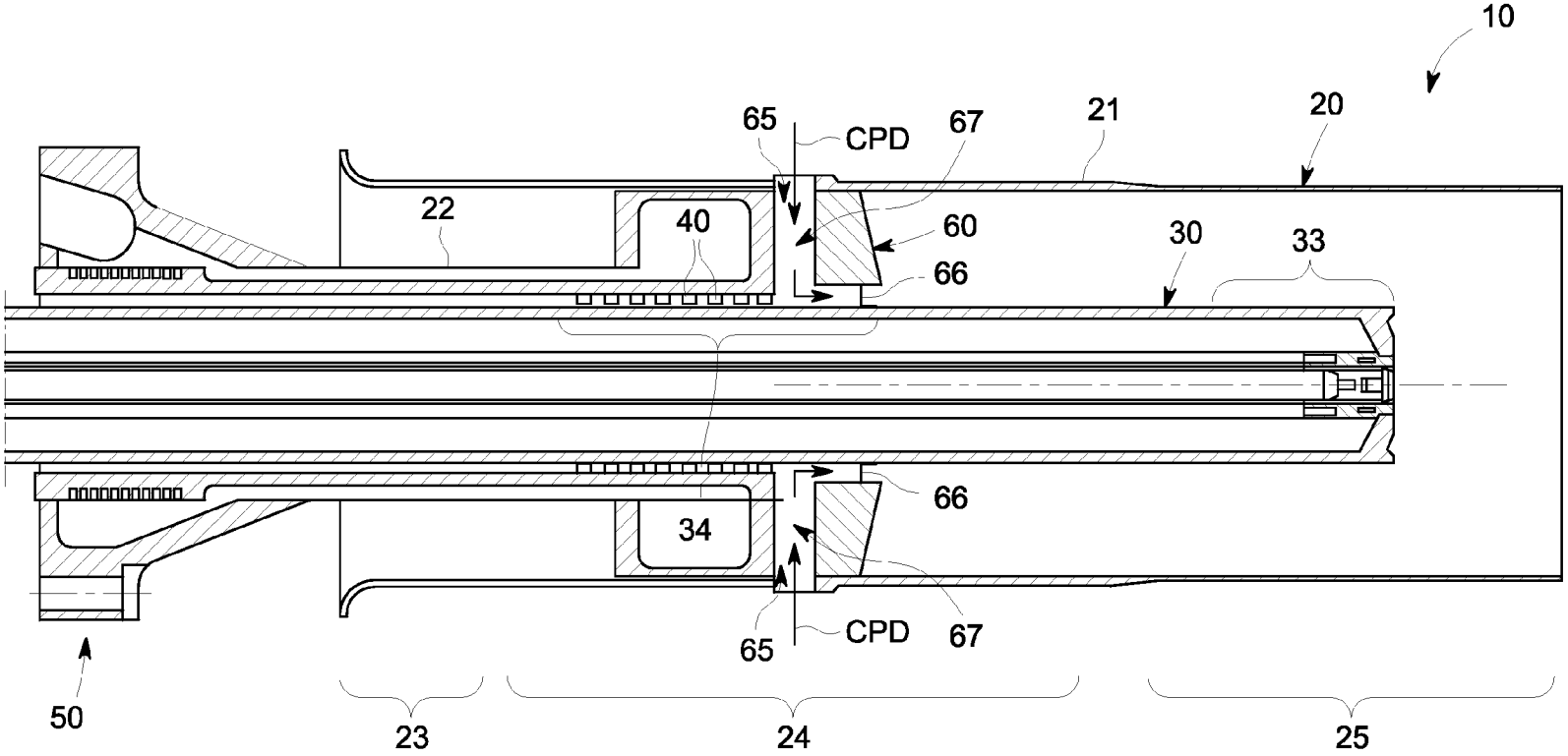
FIG. 3 is a side sectional view of the centerbody of FIG. 1 breech-loaded into the gas premixer module of FIG. 1.

With reference to FIGS. 1-3, a premixing nozzle 10 of a combustor having an endcover 500 is provided and includes an outerbody, such as a gas premixer module 20, a centerbody 30 and a sealing element 40.

As shown in FIG. 1, the gas premixer module 20 has an outer annular shroud 21 and an inner annular wall 22. The outer annular shroud 21 extends from an upstream end 23, through a mid-stream portion 24 and to a downstream end 25. At the downstream end 25, the outer annular shroud 21 is formed to define a premixing chamber 26 in an interior thereof. At the upstream end 23, the outer annular shroud 21 and the inner annular wall 22 cooperatively define an air inlet 27 through which compressor discharge air enters the gas premixer module 20. Along the mid-stream portion 24, the outer annular shroud 21 and the inner annular wall 22 cooperatively define a premixing passage 28 in which combustible fluids are premixed prior to entry into the premixing chamber 26.

Upstream from the upstream end 23, further components include a mounting flange 50, a structural stem support tube 51 and an air swirler 60. The mounting flange 50 supports the mounting of the premixing nozzle 10 in a combustor and the structural stem support tube 51 extends from the mounting flange 50 to the upstream end 23. Concentric fuel and gas tubes are defined within the mounting flange 50 and the structural stem support tube 51.

The centerbody 30 may be loaded into a breech 55 defined by the mounting flange 50, which is a component of the endcover 500, the structural stem support tube 51 and the inner annular wall 22 and is configured to deliver fuel, such as dry oil, liquid fuel, purge air and/or gas fuel to at least the premixing passage 28. The delivery may be accomplished via fuel injector holes, such as liquid fuel atomizers, formed in the outer diameter of the centerbody 30 and the inner annular wall 22. The centerbody 30 is generally tubular in shape and hollow such that fuel can be delivered to its interior 31.

As shown in FIG. 2, the centerbody includes a mounting flange end 32, a diffusion tip 33 and a central portion 34. The central portion 34 is axially interposed between the mounting flange end 32 and the diffusion tip 33. The centerbody 30 further includes liquid and purge air/gas fuel inlets 35 and 351 at the mounting flange end 32 and is at least partially cantileverably supported at the mounting flange end 32 on the endcover 500. In addition, at least the interior 31 of the centerbody 30 communicates with a combustion zone of the combustor via openings formed at the diffusion tip 33.

With the centerbody 30 at least partially cantileverably supported at the endcover 500, the sealing element 40 is disposed for radial interposition between an inner diameter of the inner annular wall 22 and an outer diameter of the centerbody 30. In this position, the sealing element 40 provides additional support for the centerbody 30 within the breech 55. The large contact surface area and relatively compliant nature of the sealing element 40 also acts as a damper to decrease the relative movement, fretting wear and vibratory stress levels experienced by the gas module and liquid module assembly, resulting in improved durability and extended component life.

As shown in FIG. 3, the sealing element 40 is installed within the inner annular wall 22 by welding, brazing, metallurgical bonding or some other similar type of bonding process. The centerbody 30 is loaded into the breech 55 by insertion thereof through the endcover 500, the breech 55 and the sealing element 40 with the diffusion tip 33 as the leading end. Upon full insertion, the mounting flange end 32 is coupled to the endcover 500 and the central portion 34 of the centerbody 30 is supported by the sealing element 40 proximate to the mid-stream portion 24 of the gas premixer module 20.

Figure 4:
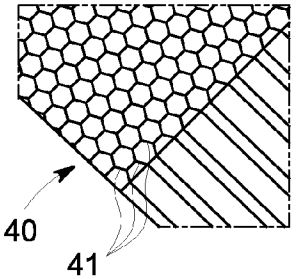
FIG. 4 is a perspective view of a sealing element.

With reference to FIG. 4, the sealing element 40 may include a deformable and/or compliant material defining a labyrinth seal and/or a honeycomb seal 41. In this way, support of the centerbody 30 can be provided without the support being so rigid that the normal vibration generated by the massive rotating turbomachinery, or by combustion induced dynamic pressure oscillations (often referred to as combustion noise or combustion dynamics) can cause fretting, contact surface wear or cracking due to fatigue. That is, the compliance and deformability of the sealing element 40 serve to dampen relative vibration between the centerbody 30 and the gas premixer module 20 such that some vibration is permitted but contact between the centerbody 30 and the gas premixer module 20 that could potentially lead to damage of those components is avoided. The sealing element 40 may also be formed with a material having a low thermal conductivity such that heat transfer between the gas premixer module 20 and the centerbody 30 is limited and such that liquid-fuel wetted surfaces in the centerbody 30 can be isolated from convection absorbed by air swirlers in the gas premixer module 20.

Referring to FIGS. 1 and 3, the outer annular shroud 21 may be further formed to define a compressor discharge air injector 65 at a location axially upstream from the premixing passage 28. The air swirler 60 of the outer annular shroud 21 may be disposed downstream from the compressor discharge air injector 65 and upstream from or within the premixing passage 28. The outer annular shroud 21 may further include a secondary sealing element 66. The secondary sealing element 66 is disposed for radial interposition between the air swirler 60 and the centerbody 30 to provide additional support to the centerbody 30 within the breach.

As shown in FIG. 3, an inner radial portion of the air swirler 60 may be radially displaced from an outer diameter of the centerbody 30 and the secondary sealing element 66 may be axially displaced from the compressor discharge air injector 65. With this arrangement, a purging film pathway 67 may be formed for compressor discharge air (CPD) entering the gas premixer module 20 through the compressor discharge air injector 65. At least a portion of the compressor discharge air that does not immediately enter the premixing passage 28 via the air swirler 60, flows radially inwardly along the compressor discharge air injector 65, impinges upon the centerbody 30 and then flows axially along the outer diameter of the centerbody 30 toward the secondary sealing element 66 before it is permitted to flow to the premixing passage 28.

A CPD film provided for by the purging film pathway 67 avoids flashback of the flame into the premixer caused by wakes, thick boundary layers and other weak secondary flows, in which the local mixture velocity is below the turbulent flame speed. This would be particularly difficult without the film when attempting to evaporate and premix diesel fuel, which autoignites in a matter of milleseconds when it reaches temperatures above approximately 400 to 500 degrees Fahrenheit. The CPD film sweeps away any liquid oil that might find its way onto those surfaces thereby avoiding solid carbon formation, which might then trip the premixer air flow creating a thick boundary layer and a wake behind the solid carbon deposit that would cause the premixed flame to creep into the premixing annulus and burn parts of the system that are not designed for flame. As such, for premixed oil combustion, the need for millions of gallons of water that would otherwise be used for NOx control is avoided. Additionally provided is the ability to purge out the boundary layers with the CPD film, and also to mount liquid fuel injectors directly on the centerbody 30.

Figure 5:
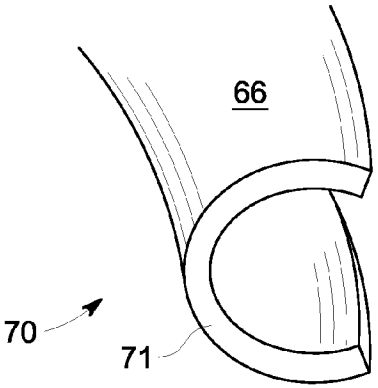
FIGS. 5-7 are perspective views of secondary sealing elements.
Figure 7:
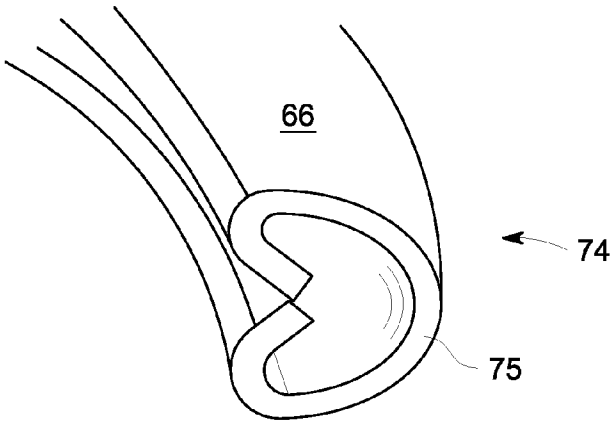
Figure 6:
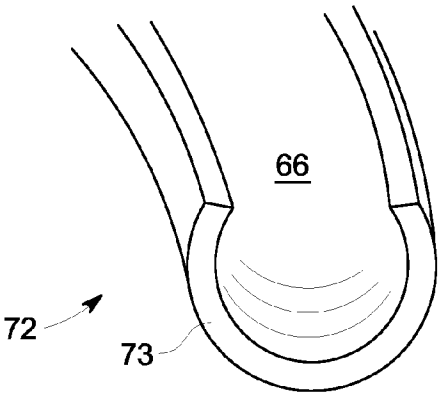

With reference to FIGS. 5-7, the secondary sealing element 66 may include one or more of a c-shaped seal 70, having a c-shaped seal body 71 in which the c-shaped cross section opens in the downstream direction (see FIG. 5), an axial c-shaped seal 72, having an axial c-shaped seal body 73 in which the c-shaped cross section open radially outwardly (see FIG. 6), and a super c-shaped seal 74, having a super c-shaped seal body 75 in which the ends of the seal curl in on one another and face in the upstream direction (see FIG. 7).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A premixing nozzle of a combustor, comprising:

a gas premixer module;

a centerbody, which is breech-loadable into the gas premixer module;

a deformable, compliant interface between the gas premixer module and the centerbody, the gas-premixer module comprising an outer annular shroud and an inner annular wall and extending from an upstream end where the outer annular shroud and the inner annular wall define an air inlet and through a mid-stream portion where the outer annular shroud and the inner annular wall define a premixing passage;

a fuel inlet upstream of the air inlet in the inner annular wall;

wherein the fuel and the air mix in the premixing passage;

the centerbody extending downstream of the premixing passage; and the deformable, compliant interface being disposed at a downstream portion of the mid-stream portion and wherein the deformable, compliant interface comprises a honeycomb seal.

2. The premixing nozzle according to claim 1, further comprising a mounting flange, a structural stem support tube and an air swirler.

3. The premixing nozzle according to claim 1, wherein the deformable, compliant interface is installed between an inner diameter of the gas premixer module and an outer diameter of the centerbody.

4. The premixing nozzle according to claim 1, wherein the centerbody comprises:

a mounting flange end;

a diffusion tip; and a central portion axially interposed between the mounting flange end and the diffusion tip and axially aligned with the deformable, compliant interface.

5. A premixing nozzle of a combustor having an endcover, the premixing nozzle comprising:

a gas premixer module mounted onto the endcover;

a centerbody, which is breech-loadable through the endcover and into the gas premixer module;

a deformable, compliant interface between the gas premixer module and the centerbody, the gas-premixer module comprising an outer annular shroud and an inner annular wall and extending from an upstream end where the outer annular shroud and the inner annular wall define an air inlet and through a mid-stream portion where the outer annular shroud and the inner annular wall define a premixing passage;

a fuel inlet upstream of the air inlet in the inner annular wall;

wherein the fuel and the air mix in the premixing passage;

the centerbody extending downstream of the premixing passage: and the deformable, compliant interface being disposed at a downstream portion of the mid-stream portion and wherein the deformable, compliant interface comprises a honeycomb seal.

6. The premixing nozzle according to claim 5, further comprising a mounting flange, a structural stem support tube and an air swirler.

7. The premixing nozzle according to claim 5, wherein the centerbody comprises:

a mounting flange end;

a diffusion tip; and a central portion axially interposed between the mounting flange end and the diffusion tip and axially aligned with the deformable, compliant interface.

8. The premixing nozzle according to claim 7, wherein the centerbody comprises liquid and gas fuel inlets at the mounting flange end.

9. The premixing nozzle according to claim 7, wherein the centerbody is cantileverably supported at the mounting flange end on the endcover.

10. The premixing nozzle according to claim 7, wherein an interior of the centerbody communicates with a combustion zone of the combustor via the diffusion tip.

11. The premixing nozzle according to claim 5, wherein the deformable, compliant interface is installed between an inner diameter of the gas premixer module and an outer diameter of the centerbody.

12. A premixing nozzle of a combustor, comprising:

an outerbody extending from an upstream end to a downstream end through a mid-stream portion and having an outer annular shroud formed to define a premixing chamber at the downstream end and an inner annular wall formed to define with the outer annular shroud an air inlet at the upstream end and a premixing passage between an outer surface of the inner annular wall and the outer annular shroud in the mid-stream portion and upstream from the premixing chamber;

a fuel inlet upstream of the air inlet in the inner annular wall;

wherein the fuel and the air mix in the premixing passage;

a centerbody, which is loaded into a breech defined by the inner annular wall, the centerbody being configured to deliver a fuel to the premixing passage via fuel injector holes formed in an outer diameter thereof; and a sealing element disposed for radial interposition between an inner diameter of the inner annular wall and an outer diameter of the centerbody to support the centerbody within the breech at a downstream portion of the mid-stream portion and wherein the sealing element comprises a honeycomb seal.

13. The premixing nozzle according to claim 12, wherein the fuel comprises liquid fuel and/or gas fuel.

14. The premixing nozzle according to claim 12, wherein the sealing element comprises a deformable material.

15. The premixing nozzle according to claim 12, wherein the sealing element comprises a compliant material.

16. The premixing nozzle according to claim 12, wherein the sealing element comprises a labyrinth seal.

17. The premixing nozzle according to claim 12, wherein the outer annular shroud is formed to define a compressor discharge air injector upstream from the premixing passage and the outerbody comprises:

a swirler vane disposed downstream from the compressor discharge air injector; and a secondary sealing element disposed for radial interposition between the swirler vane and the centerbody to support the centerbody within the breach.

18. The premixing nozzle according to claim 17, wherein an inner radial portion of the swirler vane is radially displaced from the centerbody and the secondary sealing element is axially displaced from the compressor discharge air injector.

19. The premixing nozzle according to claim 17, wherein the secondary sealing element comprises one or more of a c-shaped seal, an axial c-shaped seal and a super c-shaped seal.

* * * * *